US005429717A

United States Patent [19]

Bokström et al.

[11] Patent Number: 5,429,717

[45] Date of Patent: Jul. 4, 1995

[54] METHOD OF WASHING OF ALKALINE PULP BY ADDING CARBON DIOXIDE TO THE PULP

[75] Inventors: Monica Bokström, SpÅnga, Sweden; Raimo Rasimus, Lohja, Finland

[73] Assignee: AGA Aktiebolag, Lidingo, Sweden

[21] Appl. No.: 99,810

[22] Filed: Jul. 29, 1993

Related U.S. Application Data

[63] Continuation of Ser. No. 845,755, Mar. 2, 1992, abandoned, which is a continuation of Ser. No. 235,877, filed as PCT/SE87/00623, Dec. 21, 1987, abandoned.

[30] Foreign Application Priority Data

Dec. 22, 1986 [SE] Sweden ..... 8605510
Apr. 16, 1987 [WO] WIPO ..... PCT/SE87/00198

[51] Int. Cl.[6] ..... D21C 9/02
[52] U.S. Cl. ..... 162/60; 162/63
[58] Field of Search ..... 162/60, 29, 63

[56] References Cited

U.S. PATENT DOCUMENTS 4,000,033 12/1976 Marcel et al. ..... 162/29
4,042,452 8/1977 Arhippainen et al. ..... 162/60
4,724,045 2/1988 Ackel ..... 162/60

FOREIGN PATENT DOCUMENTS 86264 10/1942 New Zealand .
180107 3/1976 New Zealand .

OTHER PUBLICATIONS

Trinh et al, "Sodium Equilibrium In Craft Pulp Washing"., *J. of Pulp & Paper Sci:* vol. 13 No. 3; May 1987 (Presented at 1985 Tappi Pulping Conf. Hollywood, Fla.).
"Pulp Washing" (Proj No. 262); Pulp & Paper Research last of Canada Progress Report, Sep. 1982.
Derwent's Abstract No. 91532 C/51, SU730913.
Derwent's Abstract No. 18030 C/10, SU670652.

*Primary Examiner*—Steve Alvo
*Attorney, Agent, or Firm*—Calfee Halter & Griswold

[57] ABSTRACT

Method in the washing of alkaline, cellulosic pulp, for example sulphate pulp, CTMP and CMP pulp, the washing being effected in at least one stage. By an addition of carbon dioxide, there will be realised greatly reduced washing losses of, primarily, inorganic ions, as well as improved washing-out of substances which give rise to chemical oxygen demand (COD).

15 Claims, 2 Drawing Sheets

METHOD OF WASHING OF ALKALINE PULP BY ADDING CARBON DIOXIDE TO THE PULP

This is a continuation of application Ser. No. 07/845,755 filed on Mar. 2, 1992, now abandoned; which is a continuation of Ser. No. 07/235,877, filed as PCT/SE87/00623, Dec. 21, 1987, now abandoned.

TECHNICAL FIELD

The present invention relates to a method in the washing of alkaline, cellulosic pulp, the washing being effected in one or more consecutive stages.

In several processes within the cellulose industry, for instance in the manufacture of sulphate pulp and chemi-mechanical pulp, immense volumes of relatively expensive chemicals are employed. In order that these processes be profitable, it is necessary that such treatment chemicals be recycled and regenerated as far as is possible. A further—and now steadily more pressing—reason for the extensive recycling of treatment chemicals is the stringent requirements placed by central and local government authorities on low emissions of chemicals into the environment.

In order to attain washing results which answer to the requirements of such authorities, capital investment costs have had to be offset against running costs. As long as the price of energy was low, it was feasible to increase the volume of washing water, according as the requirements on wash effluent losses became stricter. It was then possible to evaporate the thus obtained large volumes of water. However, now that the price of energy is many times higher, concentrated efforts must be devoted to evolving more efficient washing equipment and more efficient washing processes which, to a considerable degree, free the pulp of its treatment chemicals.

OBJECTS OF THE PRESENT INVENTION

One object of the present invention is to reduce washing losses in the washing of alkaline pulp.

A further object of the present invention is to emasculate alkaline, cellulosic pulp of sodium ions.

A third object of the present invention is to increase the washing-out, from alkaline, cellulosic pulp, of substances which contribute to chemical oxygen demand (COD).

SOLUTION

These objects are attained according to the present invention, in the washing of alkaline, cellulosic pulp, in that, during washing in one or more stages, the pH is lowered in the washing stage or at least one washing stage, the preferred agent added to the washing stage or several washing stages being carbon dioxide.

According to one embodiment of the present invention, the pH is lowered to approximately 9.

According to a further embodiment of the present invention, the pH is lowered by carbon dioxide in one or more washing stages, as a result of which there will be attained an improved washing-out from the pulp of substances which contribute to chemical oxygen demand (COD).

The preferred agent for realising an improved washing of the pulp is carbon dioxide which is added to washing water used in the washing of the pulp and/or to the pulp suspension, prior to the washing stage. Possibly, carbon dioxide may also be added to the washing stage proper.

Carbon dioxide is the particularly preferred agent for attaining improved washing results. Carbon dioxide contains no environmentally hazardous substances such as chlorine or sulphur.

However, in order to lower the pH, other acids may be added, for example sulphuric acid, which, granted, contains sulphur, since the pulp which is washed according to the present invention has been treated, prior to the washing—with sulphate-containing treatment liquid. If used, sulphuric acid is preferably added together with carbon dioxide in order to achieve a more manifest reduction of pH. This said, the pH should not be reduced overly much, since under sir able reactions with residual lignin may then occur.

Above all, the pulp which can be washed with an addition of carbon dioxide or other pH reducing agent is sulphate pulp of softwood and deciduous or hardwood, and also chemi-mechanical pulp, CTMP and CMP.

Since the washing operation is normally performed in several stages, the pH reducing agent is added in one or more stages, the agent not being added at least in the first washing stage.

According to a particularly preferred embodiment of the present invention, the pH is reduced in the last stage of, for example three or four washing stages, to approximately 5. In such instance, use may also be made, in addition to carbon dioxide, of a mineral acid, especially sulphuric acid.

BRIEF DESCRIPTION OF THE DRAWINGS

The nature of the present invention and its aspects will be more readily understood from the following brief description of the accompanying drawings, and discussion relating thereto.

In the accompanying drawings.

DESCRIPTION OF PREFERRED EMBODIMENT

Figure 1:
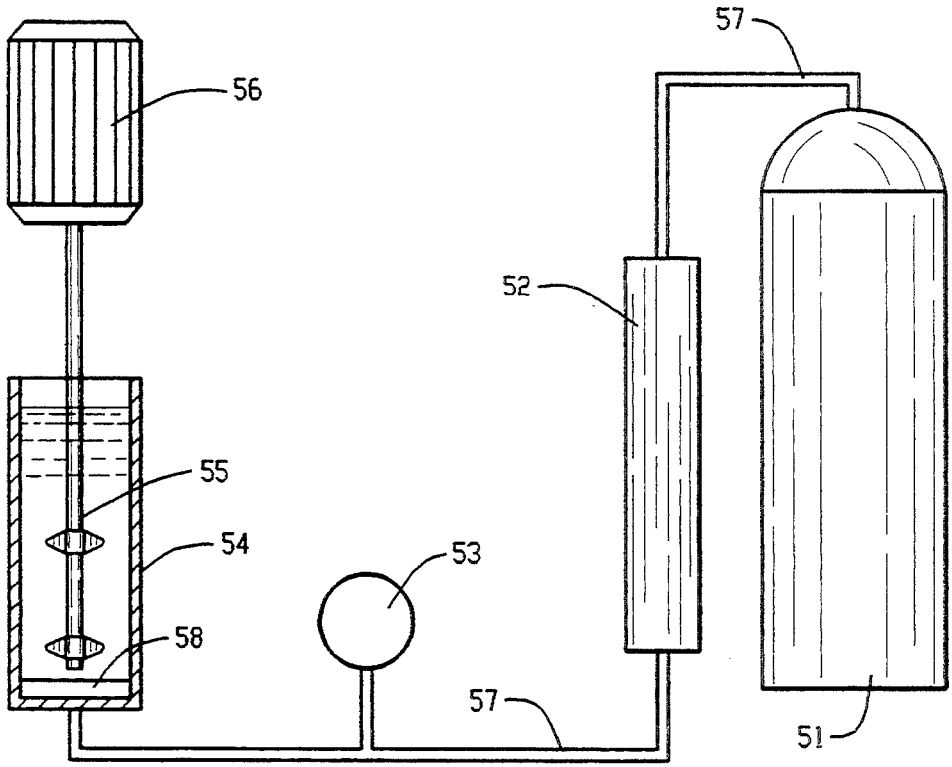
FIG. 1 is a schematic view of a laboratory plant for carrying the present invention into effect.

Referring to the drawings, reference numeral 51 in FIG. 1 designates a source for carbon dioxide which, by the intermediary of a conduit 57, is in communication with a rotameter 52, a manometer 53 and a vessel 54. The bottom 58 of the vessel 54 is a sintered body which finely divides the gas entering from the source 51. During the carbon dioxide addition, the contents of the vessel 54 are agitated by means of an agitator 55 driven by a motor 56.

To 25 g of dry pulp, there was added 200 ml of black liquor. The mixture was left to stand for 48 hours. Thereafter, the mixture was diluted with deionised water to one liter, i.e. to a 2.5% pulp concentration. The suspension underwent agitation for one hour before the filtrate was removed. The pulp was then subjected to washing in four stages. In each stage, deionised water was added to a pulp concentration of 2.5%. Each washing stage lasted for one hour under agitation. All filtrates were kept for analysis. The amount of sodium in the washing water was determined using atom absorption and COD according to the Dr. Lange method.

In the accounted experimental series, carbon dioxide was added in the second washing stage during 5, 10, 20 and 40 minutes, respectively. The carbon dioxide flow was constant and uniform in all experiments. Because of the low degree of efficiency on the dissolution of carbon dioxide in these experiments, the quantity of $CO_2$ has not been calculated. In industrial and other plants, equipment well-known to the person skilled in the Art may readily dissolve the carbon dioxide in the washing water and pulp suspension.

It will be apparent from Table 1 that the total amount of washed-out sodium will be higher when $CO_2$ is added in the 2nd washing stage. The effect becomes manifest already in the stage where the carbon dioxide addition took place, i.e. the 2nd stage. $Na^+$ is more effectively washed-out as a result of the pH reduction which results from addition of $CO_2$.

The COD washing-out procedure is more complicated. Total amount of washed-out COD will be higher in an addition of $CO_2$ in the 2nd washing stage. However, the effect is delayed and the improved washing effect does not become apparent until the 3rd washing stage.

It is not clear why the COD washing-out improves in this way. One possible explanation is of surface chemical nature. The following will then apply:

$(RCOO)_2Ca \rightarrow RCOONa$ (RCOOH) resin and fatty acids $CO_2 + H_2O \rightarrow H_2CO_3$ $Ca^{2+} + CO_3^{2-} \rightarrow CaCO_3$ $CaCO_3$ is more sparingly soluble than $(RCOO)_2Ca$.

TABLE 1

$CO_2$ addition in 2nd washing stage ($CO_2$ flow constant on addition)

| | 0 Sample | $CO_2$ 5 min | $CO_2$ 10 min | $CO_2$ 20 min | $CO_2$ 40 min |
|---|---|---|---|---|---|
| Na (tot) / Na (1) | 1.14 | 1.26 | 1.23 | 1.18 | 3.28 |
| Na (1) / Na (1 + 2) | 1.10 | 1.21 | 1.19 | 1.16 | 1.22 |
| Na (1) / Na (1 + 2 + 3) | 1.13 | 1.25 | 1.21 | 1.17 | 1.24 |
| Na (1) | | | | | |
| pH (2) | 10.8 | 7.5 | 7.4 | 7.2 | 5.7 |
| pH (4) | 9.4 | 7.6 | 7.8 | 7.6 | 7.1 |
| COD (tot) / COD (1) | 1.20 | 1.29 | 1.26 | 1.32 | 1.32 |
| COD (1 + 2) / COD (1) | 1.11 | 1.13 | 1.13 | 1.12 | 1.07 |
| COD (1 + 2 + 3) / COD (1) | 1.17 | 1.21 | 1.19 | 1.23 | 1.25 |

$\frac{Na\ (tot)}{Na\ (1)}$ relates to the quotient of total washed-out Na and washed-out Na in the first washing stage. Correspondingly the example below relates to $\frac{COD\ (1+2)}{COD\ (1)}$ COD washed out in first plus second stage through COD washed out in stage 1. No carbon dioxide was added in stage 1.

pH(2) refers to pH after the second washing stage.

Calcium carbonate is deposited temporarily, calcium being "inactivated". Calcium soaps are insoluble in character and do not form lamellar phases to the same extent as sodium soaps. The surface activity in the system increases, which gives an improved washing-out of organic substance.

A trial has been made to wash birch kraft pulp counter-currently on a laboratory scale. The purpose of this trial is to get closer to full scale conditions by using a counter-current method and to make this washing on birch kraft pulp having a higher extract content than pine kraft pulp.

Figure 2:
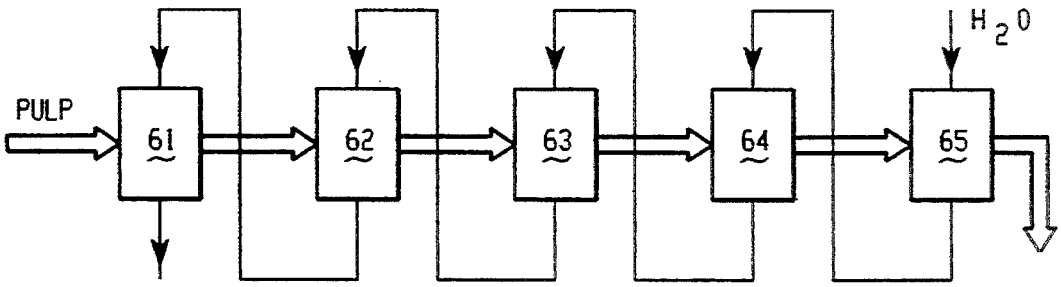
FIG. 2 is a schematic view of a laboratory plant for washing pulp countercurrently.

The washing steps are schematically shown in FIG. 2. During steady state condition a batch of pulp suspension is supplied to the first washing, step 61, and washed by using the filtrate from the second step 62. The pulp washed in the first step is thereafter supplied to the second step 62 and washed with filtrate from the third step 63. The pulp washed in the second step thereafter is supplied to the third step in which said pulp is washed with filtrate from the fourth step 64. In the fourth step the pulp is washed with filtrate from the fifth step 65. In the fifth or last step 65 the pulp is washed with deionized water.

For the washing of each batch there was used a total amount of 700 ml deionized water as a washing liquid. The washing for each step was made in a graduated cylinder and the pulp suspension was agitated during several minutes. The pulp slurry then was filtered using a Buechner funnel and 700 ml of filtrate was taken out.

For every batch of the pulp suspension 25 g of dry birch kraft pulp was mixed with 100 ml of black liquor. The suspension was allowed to stand at least 2 days before the washing was started in step 61. During this time equilibrium conditions were reached or almost reached.

Two series of trials were made, one with carbon dioxide and one without carbon dioxide. In the first series no carbon dioxide was used.

In order to build up a steady state washing system 16 batches were washed in each series. Batch No. 1 was first washed in step 61 using 700 ml of deionized water, the obtained filtrate, 700 ml, was discarded. Batch No. 1 was then taken to step 62 and washed with 700 ml of deionized water. This obtained filtrate of 700 ml was taken care of and used as washing liquid in step 61 for batch No. 2. In the third washing step 63, of batch No. 1, the pulp was washed again with 700 ml of deionized water, the obtained filtrate, 700 ml, was taken care of and used as washing liquid for batch No. 2 in step 62. The filtrate from batch No. 2 in step 62 then was used as washing liquid in step 61 for batch No. 3. The filtrate, 700 ml, from step 1 was discarded. Then batch No. 1 was washed in step 64 with 700 ml of deionized water and finally in step 65 with 700 ml deionized water. The filtrate, 700 ml from batch No. 1 in step 65 then was used as washing liquid for the next batch. Thereafter deionized water was added only to step 65 and the filtrate from that step was used for washing the next batch in step 64, etc. The filtrate from step 61 for the 12 first batches was discarded. Then the last four filtrates from step 61 were taken care of, brought together to a comparative sample and analyzed.

In the second test series carbon dioxide was added to step 65. The carbon dioxide was added during the washing, which took some minutes and took place during stirring of the pulp suspension deionized water. The steady state condition was built up in the same manner as was done in the reference series without carbon dioxide. The last four filtrates from step 61 out of the 16 filtrates obtained were brought together and analyzed.

In addition, the pH of the filtrates from all steps was measured when the steady state condition had been reached. In the following, filtrate 61 designates filtrate from step 61, filtrate 62 designates filtrate from step 62, etc.

In table 2 the pH values of the filtrates after reaching steady state condition are shown.

TABLE 2

| Filtrate | pH without $CO_2$ | pH with $CO_2$ |
|---|---|---|
| 65 | 10.3 | 6.8 |
| 64 | 10.6 | 9.4 |
| 63 | 11.0 | 10.9 |
| 62 | 11.6 | 11.8 |
| 61 | 12.1 | 12.6 |

Washed pulp, i.e. pulp from batches 12–16 were brought together to one sample, and filtrate 61 was analyzed further. Filtrate 61 designates the last four filtrates in each series containing 16 batches taken from step 61 brought together to an average sample. The results from the analysis of the filtrate are shown in table 3.

TABLE 3

| | without $CO_2$ | with $CO_2$ |
|---|---|---|
| $Na^+$ (g/l) | 3.59 | 3.81 |
| $Ca^{2+}$ (g/l) | 0.033 | 0.033 |
| COD (g/l) | 17.1 | 17.9 |

COD = Chemical oxygen demand

The results from the pulp analysis are shown in table 4.

TABLE 4

| | without $CO_2$ | with $CO_2$ |
|---|---|---|
| $Na^+$ (g/kg) | 2.00 | 1.34 |
| $Ca^{2+}$ (g/kg) | 1.10 | 1.17 |
| COD (g/kg) | 10.19 | 9.37 |
| DKM extract (%) | 0.10 | 0.08 |

DKM = dichloromethane

Addition of $CO_2$ to the last washing step has resulted in that more sodium ions and COD have been washed out of the pulp. The content of calcium ions has not been affected to any appreciable degree. The extractives content (dichloromethane) in the pulp is lower after washing with addition of carbon dioxide.

Figure 3:
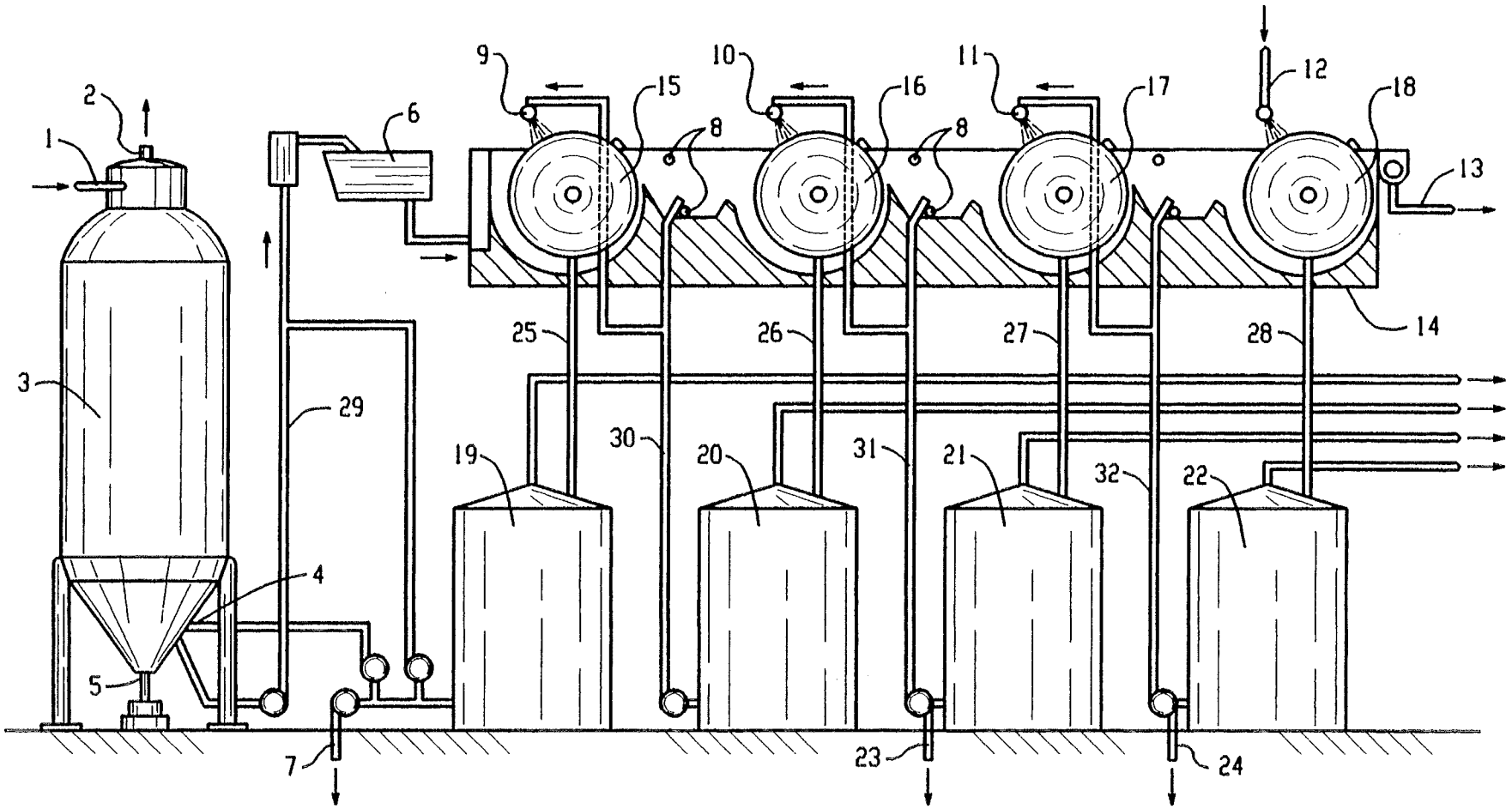
FIG. 3 is a schematic view of a slightly modified plant for washing alkaline pulp in four stages.

A modified plant for washing of pulp in sulphate cooking is illustrated in FIG. 3.

According to FIG. 3 the pulp comes from a digester (not shown) through a conduit 1 to a blow tank 3. The conduit 2 leads to a blow condensor. The pulp in the blow tank 3 is diluted with weak (thin) liquor via a conduit 4 from a weak liquor cistern 19. An agitator in the blow tank 3 is designated 5.

The pulp from the blow tank 3 is passed through a conduit 29 to a knotter screen 6. The pulp passes thence to the first washing filter 15 and subsequently to the three following washing filters 16, 17 and 18. The filtrate from the first filter 15 is collected in the weak liquor cistern 19 and the filtrate from the other three filters in the washing liquor cisterns 20, 21 and 22, respectively. The washed pulp departs from the fourth filter 18 at reference numeral 13. When the pulp passes from one filter to the next, the filter cake is comminuted by shredders 8. Filtrate from one filter is used as washing liquid in the preceding filter and dilution liquid in the same filter. Normally, pure water is added to the last filter 18 as washing liquid, entering through a conduit 12.

According to the present invention, carbon dioxide is introduced into the conduits 31 and/or 32 via conduits 23 and 24, respectively. The carbon dioxide dissolves at once in the washing liquid and is led to the filters 17 and 18, respectively through the conduits 31 and 32 and the conduits 10 and 11. The filtrate from the filter 16 passes through a conduit 26 to the cistern 20. A pH sensor device is disposed either in the cistern 20 or in the conduit 26, the sensor controlling, by the intermediary of the control and regulation equipment, the supply of carbon dioxide to the conduit 31. Correspondingly, there is disposed a pH sensor device in the conduit 27 or the cistern 21, this sensor being connected to control apparatus which maintains the pH at the predetermined level by adjusting the $CO_2$ addition via the conduit 24.

Water is added to the last washing filter 18, this water being admixed with carbon dioxide and/or sulphur dioxide. A pH sensor device may also be disposed in the conduit 28.

It has been found that it is possible to reduce the wash losses, counted as $Na_2SO_4$, by approx. 1 kg per batched kg of carbon dioxide. A suitable amount of carbon dioxide is approx. 6 kg per tonne of pulp, it being thus possible to reduce the washing loss by approx. 6 kg per tonne of pulp.

By further reducing the pH by an addition of a mineral acid, preferably sulphuric acid, and thus lowering the pH to 6 or less, even lower washing losses will be achieved.

In the manufacture of CTMP and CMP pulp, the cellulosic material is pre-treated with alkaline treatment liquid and is disintegrated in one or more refiners, normally disc refiners. The pulp suspension passes thence to a screen room. The accept therefrom then passes to a washing plant, for example of the type illustrated in FIG. 3.

Using the method according the the present invention, it is possible to improve the washing results of all alkaline, cellulosic pulp, irrespective of whether the pulp is softwood/hardwood pulp or any other type of pulp, for example produced from bagasse.

The present invention should not be considered as restricted to that disclosed above and shown on the drawings, many modifications being conceivable without departing from the spirit and scope of the appended claims.

We claim:

1. A method for washing alkaline, cellulosic pulp, in which the washing is effected in one or more consecutive washing stages, comprising the step of adding an acidifying agent comprising carbon dioxide to the washing liquid in a washing stage, wherein the carbon dioxide facilitates organic and inorganic substances adhered to the pulp to become and remain dissolved in the washing liquid, and further wherein the pH is lowered to between 9.4 and 6.8 during the step of adding the carbon dioxide.

2. The method as claimed in claim 1, further comprising the step of adding the carbon dioxide to washing water of a washing stage immediately prior to the washing stage.

3. The method as claimed in claim 2, in which the washing is effected in at least two stages, further comprising the steps of adding the carbon dioxide to all stages except the first stage.

4. The method as claimed in claims 1, 2 or 3, wherein the alkaline, cellulosic pulp is sulphate, chemi-mechanical pulp.

5. The method of claim 1, further comprising the step of adding the acidifying agent consisting essentially of carbon dioxide to a pulp suspension immediately prior to the washing stage.

6. The method of claim 1, further comprising the step of adding the acidifying agent consisting essentially of carbon dioxide to washing water of a washing stage and to a pulp suspension, immediately prior to the washing stage.

7. The method claimed in claims 1–3, 5 or 6, wherein the alkaline, cellulosic pulp is sulphate pulp.

8. The method claimed in claims 1–3, 5 or 6 wherein the alkaline, cellulosic pulp is chemi-mechanical pulp.

9. A method for washing alkaline, cellulosic pulp, in which the washing is effected in one or more consecutive washing stages, consisting essentially of the step of adding carbon dioxide to the pulp in a washing stage, wherein the carbon dioxide washes out organic as well as inorganic substances from the pulp and further wherein the pH is lowered to be between 9.4 and 6.8 during the step of adding the carbon dioxide.

10. The method as claimed in claim 9, further comprising the step of adding carbon dioxide to washing water of a washing stage immediately prior to the washing stage.

11. The method as claimed in claim 10, in which the washing is effected in at least two stages, further comprising the steps of adding the carbon dioxide to all stages except the first stage.

12. The method as claimed in claim 9, further comprising the step of adding carbon dioxide to a pulp suspension immediately prior to the washing stage.

13. The method as claimed in claim 9, further comprising the step of adding carbon dioxide to washing water of a washing stage and to a pulp suspension, immediately prior to the washing stage.

14. The method as claimed in claim 9, 10, 11, 12, or 13, wherein the alkaline, cellulosic pulp is sulphate pulp.

15. The method as claimed in claim 9, 10, 11, 12, or 13, wherein the alkaline, cellulosic pulp is chemi-mechanical pulp.

* * * * *